US012291831B1

(12) United States Patent
Chi et al.

(10) Patent No.: US 12,291,831 B1
(45) Date of Patent: May 6, 2025

(54) GROUTING PIPE AND CONSTRUCTION METHOD OF DESERT WATER STORAGE AREA

(71) Applicant: CHINA ACADEMY OF SAFETY SCIENCE AND TECHNOLOGY, Beijing (CN)

(72) Inventors: Mingbo Chi, Beijing (CN); Fubao Zhou, Beijing (CN); Hongfei Duan, Beijing (CN); Shigen Fu, Beijing (CN); Guoxin Han, Beijing (CN); Quanwu Gao, Beijing (CN); Hairui Li, Beijing (CN); Shuai Zhang, Beijing (CN); Ziyi Zhong, Beijing (CN); Ersheng Zha, Beijing (CN); Chuangchuang Dai, Beijing (CN); Lei Guan, Beijing (CN)

(73) Assignee: CHINA ACADEMY OF SAFETY SCIENCE AND TECHNOLOGY, Beijing (CN)

( * ) Notice: Subject to any disclaimer, the term of this patent is extended or adjusted under 35 U.S.C. 154(b) by 0 days.

(21) Appl. No.: 18/877,338

(22) PCT Filed: Jul. 9, 2024

(86) PCT No.: PCT/CN2024/104452

§ 371 (c)(1),
(2) Date: Dec. 20, 2024

(30) Foreign Application Priority Data

Apr. 23, 2024 (CN) ..... 202410487067.6

(51) Int. Cl.
*E02D 3/12* (2006.01)

(52) U.S. Cl.
CPC ..... *E02D 3/12* (2013.01)

(58) Field of Classification Search
CPC . E02B 3/12; E02B 3/123; E02D 17/20; E02D 5/36
See application file for complete search history.

(56) References Cited

U.S. PATENT DOCUMENTS 7,097,388 B1 * 8/2006 Mansour ..... E02D 35/00 405/230
9,988,784 B2 * 6/2018 Barron ..... E02D 5/34
(Continued)

FOREIGN PATENT DOCUMENTS

CN 201679505 U 12/2010
CN 106193030 A 12/2016
(Continued)

*Primary Examiner* — Benjamin F Fiorello
(74) *Attorney, Agent, or Firm* — SLEMAN & LUND LLP

(57) ABSTRACT

Disclosed are a grouting pipe and a construction method of a desert water storage area. An isolation layer can be constructed in any desert area to form the water storage area. A plurality of anchoring claws are arranged between an inner pipe and an outer pipe of a pipe body. The anchoring claw has a grouting flow channel for grouting into surrounding sand grains. When the grouting pipe is being laid, the anchoring claw is folded. During grouting, an elastic bag structure supports the anchoring claw. The pipe body can be firmly anchored in the sand grains. Slurry sprayed out of the anchoring claw moves from the pipe body by a certain distance, with a wider flowing range in the sand grains, and can meet and condense with slurries of other drilled holes, which facilitates better formation of the isolation layer, so that the desert water storage area is formed.

18 Claims, 8 Drawing Sheets

(56) References Cited

U.S. PATENT DOCUMENTS

| | | | | |
|---|---|---|---|---|
| 2004/0104049 | A1* | 6/2004 | Federighi | E02D 5/36<br>175/57 |
| 2004/0247397 | A1* | 12/2004 | Fox | E02D 5/44<br>405/244 |
| 2010/0178115 | A1* | 7/2010 | McVay | E02D 5/44<br>405/231 |

FOREIGN PATENT DOCUMENTS

| | | | |
|---|---|---|---|
| CN | 207598277 | U | 7/2018 |
| CN | 109923966 | A | 6/2019 |
| CN | 212104121 | U | 12/2020 |
| KR | 20100060767 | A | 6/2010 |

* cited by examiner

A–A

B–B

GROUTING PIPE AND CONSTRUCTION METHOD OF DESERT WATER STORAGE AREA

The present application claims priority to Chinese Patent Application No. 202410487067.6, filed on Apr. 23, 2024, and the entire disclosure of which is incorporated herein by reference.

TECHNICAL FIELD

The present invention relates to the technical field of desert control, and particularly to a grouting pipe and a construction method of a desert water storage area.

BACKGROUND

A desert surface is full of sand grains and difficult to store water. In addition, the lack of rain in a desert area leads to the scarcity of plants, so that the sand grains cannot be solidified, and the sand grains are highly mobile, thus being prone to sand disasters such as sandstorms.

In the prior art, sand fixation and grass and tree planting are mostly used to control the sand disasters. However, because it is difficult to store water in the desert area, it is a big problem to supply water to plants on the desert surface.

In the prior art, for example, the Chinese invention patent publication CN109923966A discloses a water storage modification planting method for desert, which comprises: selecting a low-lying desert place as a water storage reservoir, laying a seepage-proofing plate at a bottom of the water storage reservoir, then placing a water pool at the bottom, covering a filter layer on a top of the water pool, and leading out a pumping pipe from the water pool upwards. After mounting the water pool, continuing to lay a seepage-proofing plate in the water storage reservoir, and backfilling sand into the water storage reservoir until the height of the sand in the water storage reservoir is close to the height of surrounding sand.

According to the above water storage modification planting method for desert, the water storage reservoir needs to be selected according to desert terrain, and the water storage reservoir can only be provided in the low-lying desert place, with a strict condition limitation and a small application scope. If it is necessary to plant and construct the water storage reservoir in flat or high slope places of desert, the above water storage modification planting method for desert cannot meet the requirements.

In order to form the water storage reservoir in the flat or high slope places, it is necessary to form an isolation layer at a certain distance below the desert surface by combining drilling and grouting techniques. Due to loose sand grains and poor anchorage, the existing grouting pipe is difficult to meet the requirements of grouting in the desert area.

In the prior art, the Chinese utility model patent CN201679505U discloses a balanced grouting pipe, wherein the balanced grouting pipe is composed of an inner pipe and an outer pipe, an interlayer is formed between the inner pipe and the outer pipe, and a plurality of grouting holes are arranged in pipe walls of the inner pipe and the outer pipe.

Because the outer pipe of the balanced grouting pipe has a smooth structure, it is difficult to anchor the balanced grouting pipe in the sand grains. In addition, because the grouting can only be carried out through the grouting holes in the pipe wall, slurry will be completely absorbed by the sand grains after leaving the grouting pipe and entering the sand grains, so that the slurry will gather near the pipe wall of the grouting pipe, difficult to effectively form the isolation layer.

SUMMARY

The present invention aims to overcome the defects in the prior art, and provide a grouting pipe and a construction method of a desert water storage area, wherein a plurality of anchoring claws are arranged between an inner pipe and an outer pipe of a pipe body, an elastic bag structure used for pushing the anchoring claw outwards is arranged, and the anchoring claw is provided with a grouting flow channel used for grouting into surrounding sand grains. When the grouting pipe is being laid, the anchoring claw is folded without influencing a movement of the grouting pipe. During grouting, the elastic bag structure supports the anchoring claw, so that the anchoring claw swings outwards through an outer pipe opening, the anchoring claw is deeply inserted into the surrounding sand grains and grouts into the surrounding sand grains. The pipe body can be firmly anchored in the sand grains. The slurry sprayed out of the anchoring claw moves from the pipe body by a certain distance, with a wider flowing range in the sand grains, and can meet and condense with slurries of other drilled holes, which facilitates better formation of the isolation layer, so that the desert water storage area is formed.

The present invention provides a grouting pipe, wherein the grouting pipe is configured to construct an isolation layer in a desert area to form a desert water storage area above; wherein

- the grouting pipe comprises a bendable pipe body and a plurality of anchoring claws connected around the pipe body and provided with a grouting flow channel;
- the pipe body comprises an inner pipe and an outer pipe sleeved on the inner pipe, an annular cavity is formed between the inner pipe and the outer pipe, the pipe body comprises a proximal end and a distal end which are oppositely arranged, and a distal end valve is arranged in a distal end of the inner pipe;
- the anchoring claw is mounted in the annular cavity through a rotating shaft, an outer pipe opening is arranged in an area on the outer pipe corresponding to the anchoring claw, and the anchoring claw is capable of swinging outwards through the outer pipe opening;
- an elastic bag structure capable of driving the anchoring claw to swing outwards is connected between the anchoring claw and the inner pipe, and the elastic bag structure communicates the inner pipe with the grouting flow channel; wherein
- when the elastic bag structure is in a retracted state, the anchoring claw is accommodated in the annular cavity and/or the outer pipe opening under an action of the elastic bag structure; and
- when the elastic bag structure is filled with slurry and in an expanded state, the anchoring claw swings outwards through the outer pipe opening, and the anchoring claw swinging outwards is configured to be inserted into surrounding sand grains for grouting into the surrounding sand grains.

In one of optional technical solutions, the anchoring claw comprises an anchoring claw main body and a plurality of grouting nozzles arranged at an edge of the anchoring claw main body, the grouting flow channel is arranged in the anchoring claw main body, and the grouting nozzles are communicated with the grouting flow channel;

the rotating shaft is arranged on a distal end side of the outer pipe opening, a distal end of the anchoring claw main body is pivotally connected with the rotating shaft, and a proximal end of the anchoring claw main body is provided with a pointed head; wherein when the anchoring claw swings outwards, the proximal end of the anchoring claw main body obliquely extends towards a proximal end side of the pipe body.

In one of optional technical solutions, when the anchoring claw swings outwards through the outer pipe opening, the proximal end of the pipe body is pulled, so that the pointed head of the anchoring claw main body is inserted into the surrounding sand grains.

In one of optional technical solutions, the pointed head is provided with at least one slurry spraying port; and the plurality of grouting nozzles are arranged on a main body outer surface of the anchoring claw main body far away from the inner pipe.

In one of optional technical solutions, the grouting nozzle comprises a main nozzle and a plurality of auxiliary nozzles arranged radially around the main nozzle, wherein an axis of the main nozzle is vertical to the main body outer surface, and an included angle formed between an axis of the auxiliary nozzle and the main body outer surface is an acute angle.

In one of optional technical solutions, multiple groups of anchoring claw assemblies are arranged along an axial direction of the pipe body, and each group of anchoring claw assemblies comprises a plurality of anchoring claws arranged at intervals along a circumferential direction of the pipe body.

In one of optional technical solutions, a liquid inlet of the elastic bag structure is communicated with a grouting channel of the inner pipe, and a first valve is arranged in the liquid inlet;

a liquid outlet of the elastic bag structure is communicated with the grouting flow channel, and a second valve is arranged in the liquid outlet; and wherein the second valve is opened later than the first valve.

In one of optional technical solutions, when the inner pipe is filled with the slurry and has a pressure up to a first pressure value, the first valve is opened; and when the elastic bag structure is filled with the slurry and has a pressure up to a second pressure value, the second valve is opened; and wherein the second pressure value is greater than the first pressure value.

In one of optional technical solutions, the elastic bag structure comprises an outer plate connected with the anchoring claw, an inner plate connected with the inner pipe, and an annular elastic bag body connected between the outer plate and the inner plate, the liquid inlet is arranged in the inner plate, and the liquid outlet is arranged in the outer plate; and a reinforcing framework is arranged in the annular elastic bag body.

The present invention further provides a construction method of a desert water storage area using the grouting pipe according to any one of the technical solutions above; wherein the construction method of the desert water storage area comprises the following steps:

S01: pre-selecting an area for forming the water storage area in the desert area, pre-planning the number and positions of holes to be drilled, and pre-preparing the grouting pipe;

S02: drilling the hole and laying the grouting pipe below a desert surface by using a directional drilling machine until the distal end of the pipe body is exposed upwards above the desert surface, and closing the distal end valve; wherein the distal end of the pipe body is in the front in a drilling direction;

S03: starting to grout from the proximal end of the inner pipe until the elastic bag structure supports the anchoring claw outwards;

S04: pulling the pipe body against a supporting direction of the anchoring claw, so that the anchoring claw is inserted into the surrounding sand grains and grouts into the surrounding sand grains;

S05: repeating the steps S02 to S04 until the construction of holes, the laying of grouting pipes, and the grouting are all finished; and

S06: forming the isolation layer after the slurry is solidified with the surrounding sand grains, and forming the desert water storage area above the isolation layer.

By adopting the above technical solutions, the application has the following beneficial effects.

According to the grouting pipe and the construction method of the desert water storage area provided by the present invention, the isolation layer can be constructed in any desert area to form the water storage area, which avoids a limitation of desert terrain and expands an application range.

The grouting pipe comprises the bendable pipe body and the plurality of anchoring claws, and the anchoring claw is provided with the grouting flow channel used for grouting into the surrounding sand grains. The outer pipe of the pipe body is provided with the outer pipe opening in the area corresponding to the anchoring claw, and the elastic bag structure for pushing the anchoring claw outwards is arranged between the inner pipe of the pipe body and the anchoring claw. When the grouting pipe is being laid, the anchoring claw is pulled and folded by the elastic bag structure without influencing the movement of the grouting pipe. During grouting, the elastic bag structure is filled with the slurry and thus expands, so as to support the anchoring claw, so that the anchoring claw swings outwards through the outer pipe opening. The anchoring claw is deeply inserted into the surrounding sand grains and grouts into the surrounding sand grains, and the pipe body can be firmly anchored in the sand grains. The slurry sprayed out of the anchoring claw moves from the pipe body by a certain distance, with a wider flowing range in the sand grains, and can meet and condense with slurries of other drilled holes, which facilitates better formation of the isolation layer, so that the desert water storage area is formed.

DESCRIPTION OF THE DRAWINGS

With reference to the drawings, the disclosure of the present invention will be more easily understood. It should be understood that: these drawings are merely used for illustration, and are not intended to limit the scope of protection of the present invention. In the drawings.

EMBODIMENT

Figure 1:
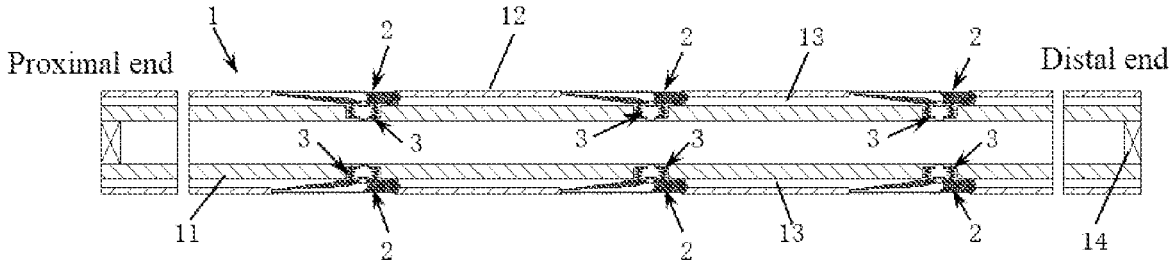
FIG. 1 is a sectional view of a grouting pipe provided by an embodiment of the present invention, wherein an anchoring claw is pulled and folded by an elastic bag structure.
Figure 2:
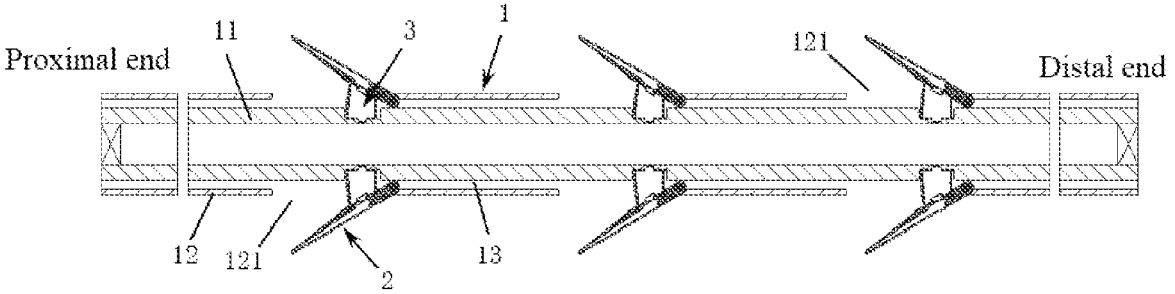
FIG. 2 is a sectional view of the grouting pipe provided by an embodiment of the present invention, wherein the anchoring claw is open and supported by the elastic bag structure.

The specific embodiments of the present invention will be further described with reference to the drawings hereinafter. The same parts are denoted by the same reference numerals. It should be noted that the terms "front", "back", "left", "right", "up", and "down" used in the following description refer to the directions in the drawings, and the terms "inner" and "outer" refer to the directions toward or far away from geometric centers of specific parts respectively.

With reference to FIG. 1 to FIG. 6, FIG. 10 to FIG. 11 and FIG. 12 to FIG. 18, an embodiment of the present invention provides a grouting pipe, wherein the grouting pipe is used for constructing an isolation layer 5 in a desert area to form a desert water storage area.

The grouting pipe comprises a bendable pipe body 1 and a plurality of anchoring claws 2 connected around the pipe body 1 and provided with a grouting flow channel 23.

The pipe body 1 comprises an inner pipe 11 and an outer pipe 12 sleeved on the inner pipe 11. An annular cavity 13 is formed between the inner pipe 11 and the outer pipe 12. The pipe body 1 comprises a proximal end and a distal end which are oppositely arranged, and a distal end valve 14 is arranged in a distal end of the inner pipe 11.

The anchoring claw 2 is mounted in the annular cavity 13 through a rotating shaft 15. An outer pipe opening 121 is arranged in an area on the outer pipe 12, corresponding to the anchoring claw 2. The anchoring claw 2 is capable of swinging outwards through the outer pipe opening 121.

An elastic bag structure 3 capable of driving the anchoring claw 2 to swing outwards is connected between the anchoring claw 2 and the inner pipe 11, and the elastic bag structure 3 communicates the inner pipe 11 with the grouting flow channel 23.

When the elastic bag structure 3 is in a retracted state, the anchoring claw 2 is accommodated in the annular cavity 13 and/or the outer pipe opening 121 under an action of the elastic bag structure 3.

When the elastic bag structure 3 is filled with slurry and in an expanded state, the anchoring claw 2 swings outwards through the outer pipe opening 121, and the anchoring claw 2 swinging outwards is inserted into surrounding sand grains for grouting into the surrounding sand grains.

The grouting pipe provided by the present invention is mainly used in the desert area, and the isolation layer 5 can be constructed in any desert area to form the water storage area, which avoids a limitation of desert terrain and expands an application range.

The proximal end and the distal end involved in the present invention are two opposite ends of one element, the proximal end refers to the end closer to a directional drilling machine during construction, and the distal end refers to the end farther away from the directional drilling machine during construction.

The slurry in the present invention may be prior art cement slurry or microbial slurry. The cement sand-fixing technology and the microbial sand-fixing technology are mature technologies, and thus ingredients of the cement slurry and the microbial slurry will not be described in details herein.

The grouting pipe comprises a pipe body 1, a plurality of anchoring claws 2 and a plurality of elastic bag structures 3. The pipe body 1 is a plastic pipe, which can be bent and adapted according to a shape of a drilled hole. The proximal end of the pipe body 1 is used to be connected with the directional drilling machine, and the distal end of the pipe body 1 extends out of a desert surface from the drilled hole when the construction is finished.

The pipe body 1 comprises the inner pipe 11 and the outer pipe 12. The outer pipe 12 is sleeved on the inner pipe 11. An inner diameter of the outer pipe 12 is greater than an outer diameter of the inner pipe 11, and the annular cavity 13 is formed between the two pipes. The distal end valve 14 is arranged in the distal end of the inner pipe 11. A proximal end valve may also be mounted in the proximal end of the inner pipe 11, as required. The proximal end of the inner pipe 11 is used for grouting, and during grouting, the distal end valve 14 is closed to maintain a pressure in the pipe. A length of the outer pipe 12 is approximately equal to a length of the inner pipe 11. The proximal end and the distal end of the outer pipe 12 can be connected with the proximal end and the distal end of the inner pipe 11 through a connecting ring.

A plurality of grouting ports 110 and a plurality of pipe wall grooves 111 are arranged on a pipe wall of the inner pipe 11, and the pipe wall grooves 111 are used for mounting the elastic bag structures 3 and providing guidance for the expansion and retraction of the elastic bag structures 3. A groove bottom of each pipe wall groove 111 is provided with one grouting port 110. The grouting port 110 is communicated with a central channel (grouting channel) of the inner pipe 11.

On the outer pipe 12, an outer pipe opening 121 is provided corresponding to the outer side of each pipe wall groove 111. A size of the outer pipe opening 121 is greater than a size of the anchoring claw 2, and the outer pipe opening 121 is used for the anchoring claw 2 to pass through.

The rotating shaft 15 is arranged in the annular cavity 13, and the rotating shaft 15 may be connected with the inner pipe 11 through a connecting rod 112. A thickness of the annular cavity 13 may be set as required to meet the requirement of mounting the anchoring claw 2.

The outer pipe 12 may have a half-and-half structure, so that the elastic bag structure 3, the anchoring claw 2 and the inner pipe 11 are mounted first, and then the outer pipe 12 is mounted. The two halves of the outer pipe 12 may be connected by a buckle, a clamp, and the like.

The anchoring claw 2 may be a plastic anchoring claw or a metal anchoring claw, and the grouting flow channel 23 is arranged in the anchoring claw 2. The anchoring claw 2 is not only used for anchoring in the sand grains, but also used for spraying the slurry to the surrounding sand grains, so as to condense the surrounding sand grains together. One end of the anchoring claw 2 is pivotally connected with the rotating shaft 15, and the rotating shaft 15 passes through a through hole at the end of the anchoring claw 2. The other end of the anchoring claw 2 is gradually tapered to form a claw shape, so as to play an anchoring role. An outlet of the grouting flow channel 23 is located at an edge of the anchoring claw 2. Several outlets of the grouting flow channel 23 may be arranged at the edge of the anchoring claw 2, so as to enlarge a grouting area or region. A plurality of grouting flow channels 23 may be arranged in the anchoring claw 2 as required.

A position of the anchoring claw 2 roughly corresponds to the outer pipe opening 121. In a normal state, the anchoring claw 2 is accommodated in the annular cavity 13 and/or the outer pipe opening 121, not protruding outside the outer pipe 12, which will not hinder the laying of the pipe body 1. During grouting, when a certain pressure is reached, the anchoring claw 2 can be supported outwards by the expanded elastic bag structure 3, and the anchoring claw 2 rotates around the rotating shaft 15 and swings outwards from the outer pipe opening 121.

The elastic bag structure 3 is a bag with a cavity, which may be made of a rubber material. A framework may be arranged in the rubber material and/or the thickness and the toughness of the rubber material can be increased as required, so as to improve the ability to withstand a pressure of the slurry up to 10 MPa. A plurality of corrugated creases may be arranged on the bag body as required, so as to facilitate the retraction and expansion of the bag.

In a normal state, the elastic bag structure 3 is in a retracted state, wherein a main part of the elastic bag structure 3 is located in the pipe wall groove 111, one end of the elastic bag structure 3 is connected with the groove bottom of the pipe wall groove 111, and the cavity of the elastic bag structure 3 is communicated with the grouting port 110. A valve may be arranged in the grouting port 110 or in a liquid inlet of the cavity as required. The other end of the elastic bag structure 3 is located outside the pipe wall groove 111, and the other end of the elastic bag structure 3 is connected with the anchoring claw 2. A liquid outlet of the cavity is connected with an inlet of the grouting flow channel 23. A valve may be arranged in the inlet of the grouting flow channel 23 or the liquid outlet of the cavity as required. The forementioned valve may be an electric valve or a pressure valve, and is preferably a pressure valve. The pressure valve may be automatically opened and closed according to the pressure of the slurry.

When the elastic bag structure 3 is in a retracted state, the elastic bag structure pulls the anchoring claw 2, so that the anchoring claw 2 is accommodated in the annular cavity 13 and/or the outer pipe opening 121.

The elastic bag structure 3 is located on one side of the rotating shaft 15. When the slurry is injected into the elastic bag structure 3, the elastic bag structure 3 starts grouting and expanding, so that the anchoring claw 2 may be pushed to rotate around the rotating shaft 15 to swing outwards from the outer pipe opening 121. After the elastic bag structure 3 is fully filled with the slurry, the swing of the anchoring claw 2 reaches a maximum angle.

A baffle 122 is arranged at the end of the outer pipe opening 121 close to the rotating shaft 15 as required, and a part of the baffle 122 shields the rotating shaft 15. When the anchoring claw 2 swings outwards to the maximum angle, the anchoring claw 2 makes contact with the baffle 122, so that the baffle 122 plays a role in limiting the anchoring claw 2. Preferably, the maximum swing angle of the anchoring claw 2 is 30°.

When the anchoring claw 2 swings outwards, the slurry in the elastic bag structure 3 is sprayed out through the outlet of the grouting flow channel 23. When the anchoring claw 2 swings outwards, the anchoring claw 2 is deeply inserted into the surrounding sand grains, and the pipe body 1 is firmly anchored in the sand grains. The slurry sprayed out of the anchoring claw 2 moves from the pipe body 1 by a certain distance, with a wider flowing range in the sand grains and a larger grouting radius, and can meet and condense with slurries of other drilled holes, which facilitates better formation of the isolation layer 5, so that the desert water storage area is formed.

Construction steps of forming the desert water storage area in the desert area by adopting the grouting pipe of the present invention are approximately as follows.

Figure 12:
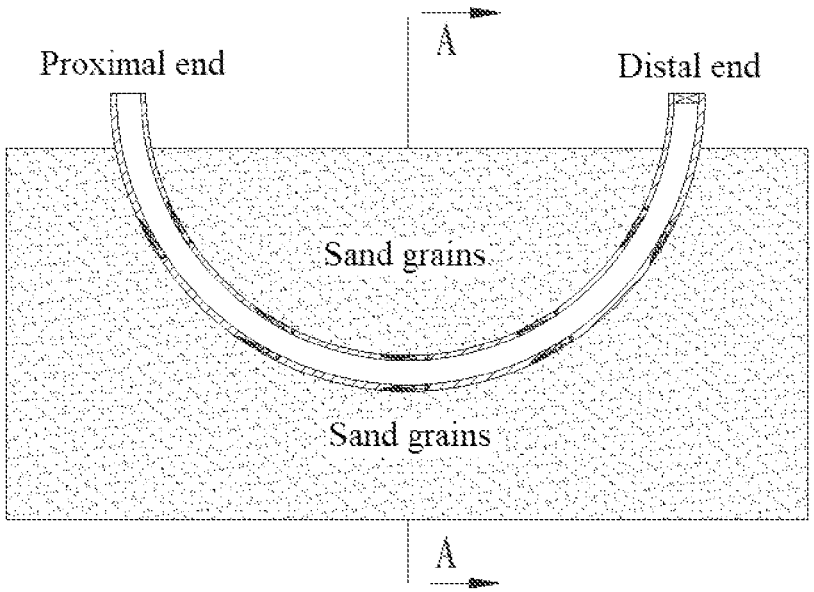
FIG. 12 is a schematic diagram of a construction method of a desert water storage area provided by an embodiment of the present invention, showing drilling a hole and laying a grouting pipe below a desert surface.
Figure 13:
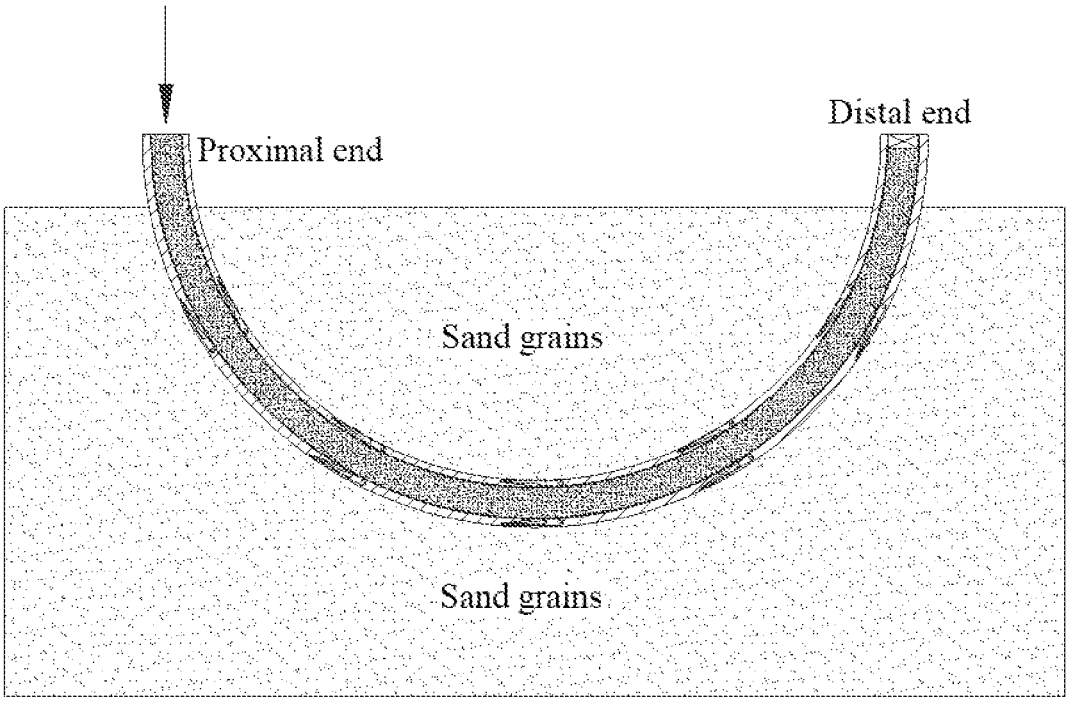
FIG. 13 is a schematic diagram of the construction method of the desert water storage area provided by an embodiment of the present invention, showing grouting from a proximal end of the inner pipe.
Figure 14:
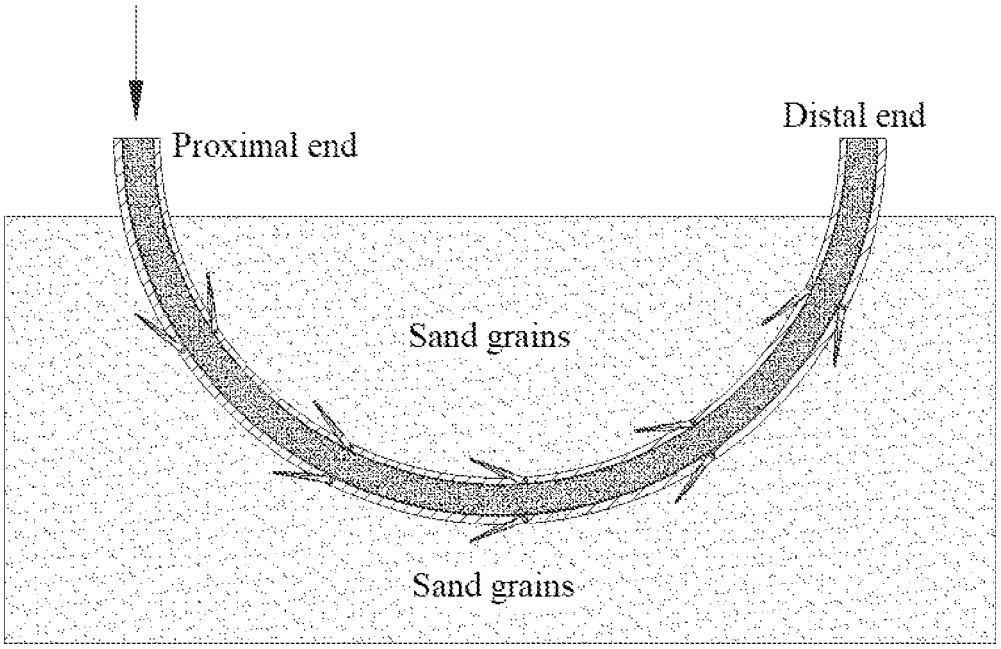
FIG. 14 is a schematic diagram of the construction method of the desert water storage area provided by an embodiment of the present invention, showing supporting the anchoring claw outwards by the elastic bag structure after a period of grouting.
Figure 15:
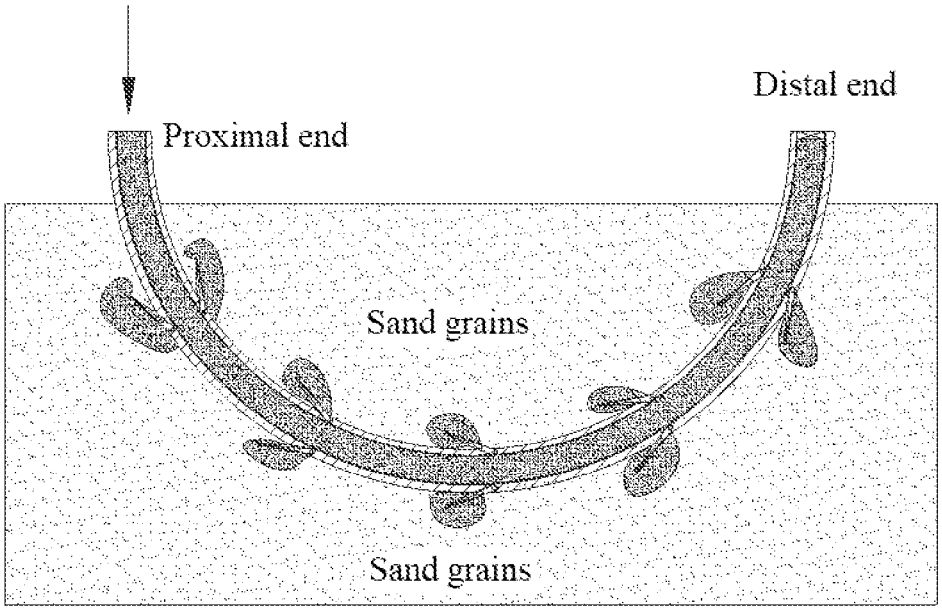
FIG. 15 is a schematic diagram of the construction method of the desert water storage area provided by an embodiment of the present invention, showing condensation of the slurry with surrounding sand grains after grouting.
Figure 16:
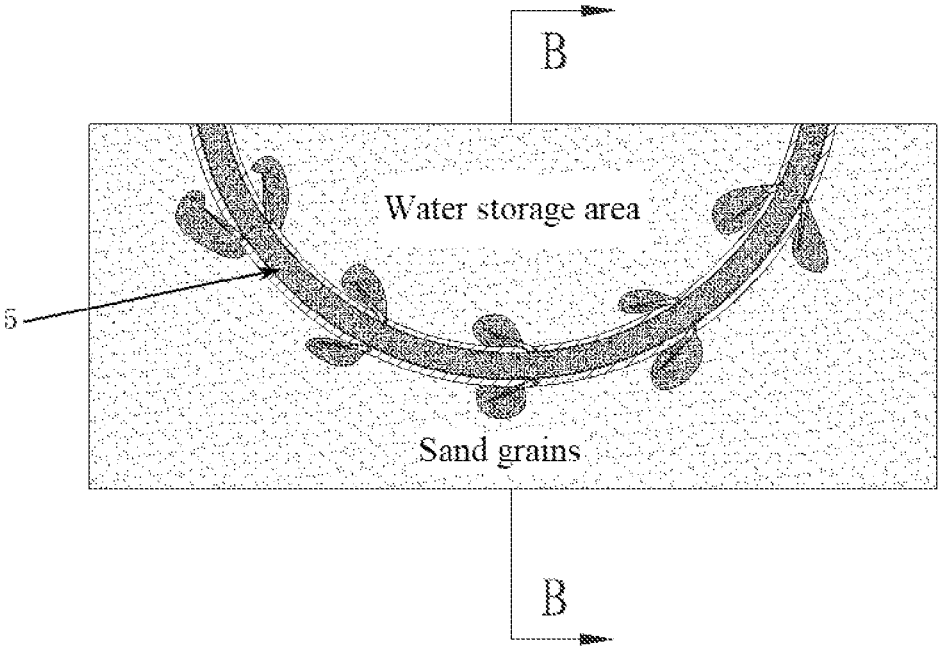
FIG. 16 is a schematic diagram of the construction method of the desert water storage area provided by an embodiment of the present invention, showing the pipe body with proximal and distal ends removed.
Figure 17:
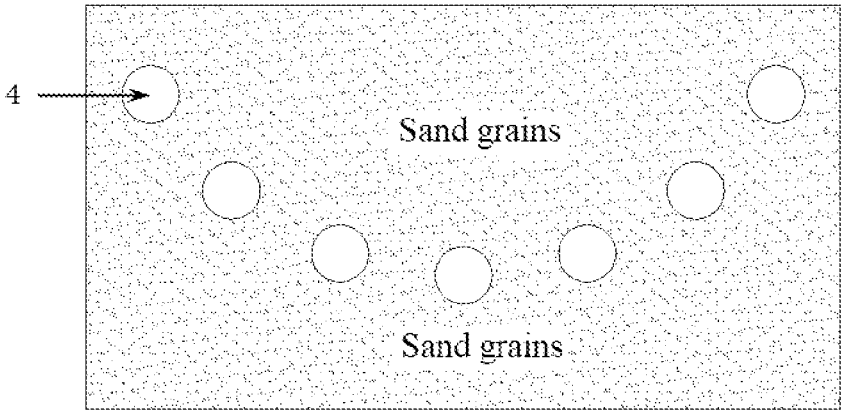
FIG. 17 is a sectional view in a direction A-A of FIG. 12, which shows a schematic diagram of layout of drilled holes along a direction perpendicular to the grouting pipe.
Figure 18:
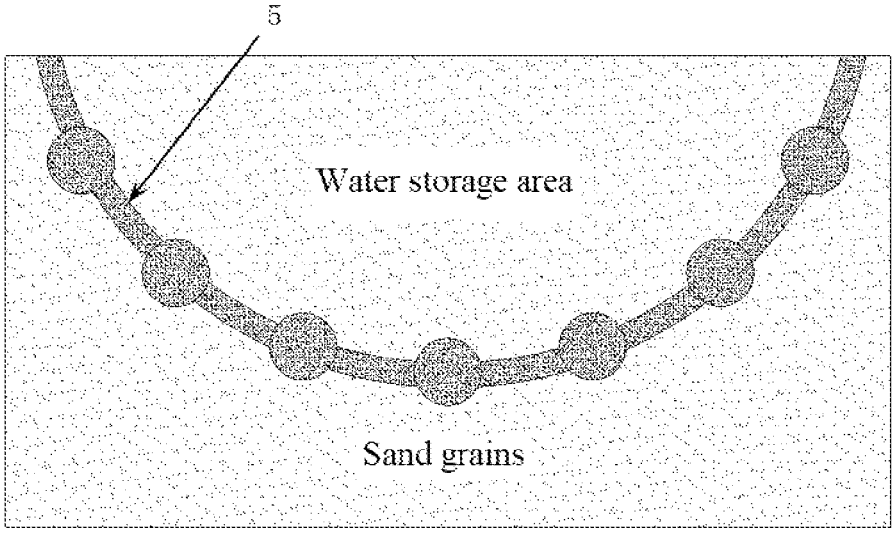
FIG. 18 is a sectional view in a direction B-B of FIG. 16, which shows a schematic diagram of an isolation layer formed after gathering and condensation of the slurry between adjacent drilled holes along the direction perpendicular to the grouting pipe.

In a first step, an area for forming the water storage area in the desert area is pre-selected, the number of holes to be drilled and the positions of the holes are pre-planned, and the grouting pipe is pre-prepared. For example, as shown in FIG. 12, a hole to be drilled and a curvature of the grouting pipe after laying are pre-planned. As shown in FIG. 17, it is necessary to design a distance D between two adjacent holes 4 along a direction perpendicular to the drilling. The distance D may be calculated according to a grouting radius r of the grouting pipe, preferably $D \leq 2r$. A shape of the hole 4 is set as required, for example, the drilled hole 4 is arc-shaped and a plurality of spaced holes 4 are arranged in an arc, so that a bottom portion of the desert water storage area is a hemisphere or a part of the hemisphere.

In a second step, the hole 4 is constructed below the desert surface by using the directional drilling machine. The hole 4 may be constructed first and then the grouting pipe is laid, alternatively, the hole 4 may be constructed while the grouting pipe is laid. The directional drilling machine is an integrated drilling and grouting machine, which belongs to the prior art, and thus will not be described in detail herein. Specifically, the proximal end of the pipe body 1 is connected with the directional drilling machine. The distal end of the pipe body 1 enters into the drilled hole 4 first, and finally, the distal end of the pipe body 1 is exposed upwards above the desert surface to finish laying the grouting pipe. Then the distal end valve 14 is closed to prevent the slurry from being discharged from the distal end of the inner pipe 11 during grouting.

In a third step, the directional drilling machine is used to start to grout from the proximal end of the inner pipe 11, and after the inner pipe 11 is fully filled with the slurry, the slurry will rush into the elastic bag structure 3, and the elastic bag structure 3 expands to support the anchoring claw 2 outwards.

In a fourth step, the pipe body 1 is pulled against a supporting direction of the anchoring claw 2, so that the anchoring claw 2 is inserted into the surrounding sand grains and grouts into the surrounding sand grains. Specifically, if the anchoring claw 2 obliquely extends towards the proximal end side, the proximal end of the pipe body 1 will be pulled, so that the anchoring claw 2 moves towards the proximal end side and is inserted deeper into the surrounding sand grains. If the anchoring claw 2 obliquely extends towards the distal end side, the distal end of the pipe body 1 will be pulled, so that the anchoring claw 2 moves towards the distal end side and is inserted deeper into the surrounding sand grains.

In a fifth step, the second step to the fourth step are repeated until the construction of holes, the laying of grouting pipes, and the grouting are all finished.

In a sixth step, after the slurry solidifies with the surrounding sand grains, the slurry coming from two adjacent grouting pipes meets and condenses with the sand gains to form the isolation layer 5, so that the desert water storage area is formed above the isolation layer 5, which may be used to store water resource, wherein the water resource may be precipitation or allocated water to facilitate planting on the desert surface, thus realizing sand fixation.

After the isolation layer 5 is formed, the proximal end and the distal end of the pipe body 1 exposed from the desert surface may be removed by cutting as required.

After the elastic bag structure 3 expands to support the anchoring claw 2 outwards, even if the elastic bag structure 3 is broken, the slurry will also flow into the surrounding sand grains through a broken place and the outer pipe opening 121, and the isolation layer 5 may still be formed.

In one of embodiments, as shown in FIG. 1 to FIG. 6, the anchoring claw 2 comprises an anchoring claw main body 21 and a plurality of grouting nozzles 22 arranged at an edge of the anchoring claw main body 21. The grouting flow channel 23 is arranged in the anchoring claw main body 21, and the grouting nozzles 22 are communicated with the grouting flow channel 23.

The rotating shaft 15 is arranged on a distal end side of the outer pipe opening 121. A distal end of the anchoring claw main body 21 is pivotally connected with the rotating shaft 15, and a proximal end of the anchoring claw main body 21 is provided with a pointed head 212.

When the anchoring claw 2 swings outwards, the proximal end of the anchoring claw main body 21 obliquely extends towards the proximal end side of the pipe body 1.

In this embodiment, the anchoring claw 2 comprises the anchoring claw main body 21 and the plurality of grouting nozzles 22. The anchoring claw main body 21 is plate-shaped with a wide distal end and a narrow proximal end. The grouting flow channel 23 is arranged in the anchoring claw main body 21. The plurality of grouting nozzles 22 are arranged at the edge of the anchoring claw main body 21, and preferably arranged at the edge of the anchoring claw main body 21 oriented to the outside. Each grouting nozzle 22 is communicated with the grouting flow channel 23. A shape, a size and the like of the grouting nozzle 22 may be set as required, which can satisfy the spraying of the slurry.

The rotating shaft 15 is arranged on the distal end side of the outer pipe opening 121. The distal end of the anchoring claw main body 21 is provided with a connecting hole, and the distal end of the anchoring claw main body 21 is pivotally connected with the rotating shaft 15. The proximal end of the anchoring claw main body 21 is provided with the pointed head 212 for penetrating into the sand grains.

When the anchoring claw 2 swings outwards, the proximal end of the anchoring claw main body 21 obliquely extends towards the proximal end side of the pipe body 1.

By such arrangement, when the grouting pipe is being laid, the distal end of the pipe body 1 moves forwards. In addition, due to the pivotal connection between the distal end of the anchoring claw main body 21 and the rotating shaft 15, when the grouting pipe is being laid, the moving direction of the pipe body 1 is towards the proximal end of the anchoring claw main body 21, instead of against the proximal end of the anchoring claw main body 21, so that the anchoring claw main body 21 will not be supported outwards by mistake to affect the laying of the grouting pipe.

In one of embodiments, when the anchoring claw 2 swings outwards through the outer pipe opening 121, the proximal end of the pipe body 1 is pulled, so that the pointed head 212 of the anchoring claw main body 21 is inserted into the surrounding sand grains.

Figure 3:
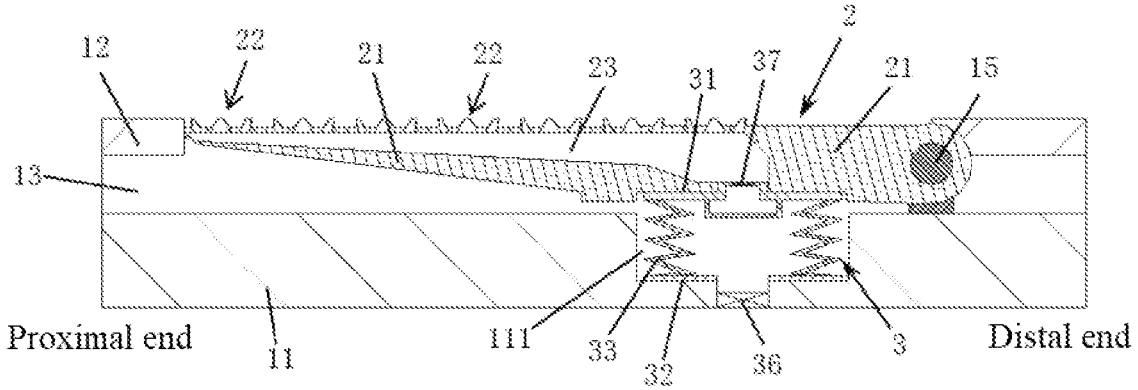
FIG. 3 is a partially enlarged view of areas where the anchoring claw and the elastic bag structure in FIG. 1 are mounted.
Figure 4:
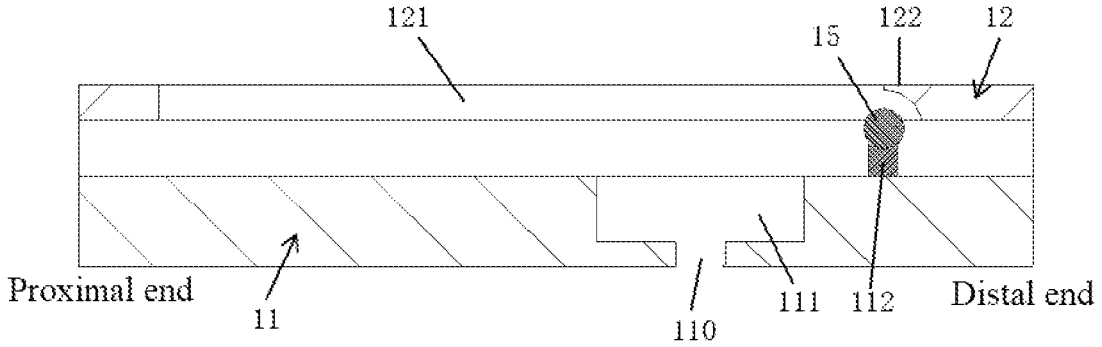
FIG. 4 is a partially enlarged view of areas on an inner pipe and an outer pipe where the anchoring claw and the elastic bag structure in FIG. 3 are mounted.
Figure 5:
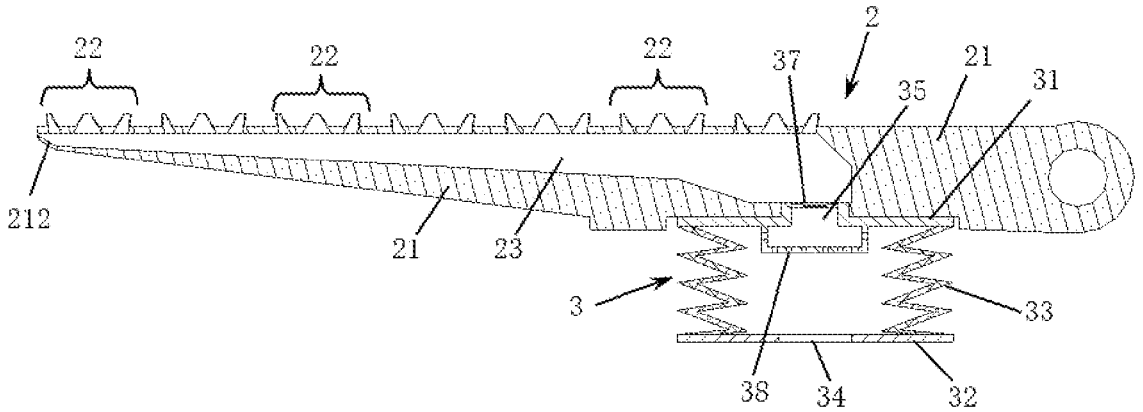
FIG. 5 is a schematic diagram of assembly of the anchoring claw and the elastic bag structure.
Figure 6:
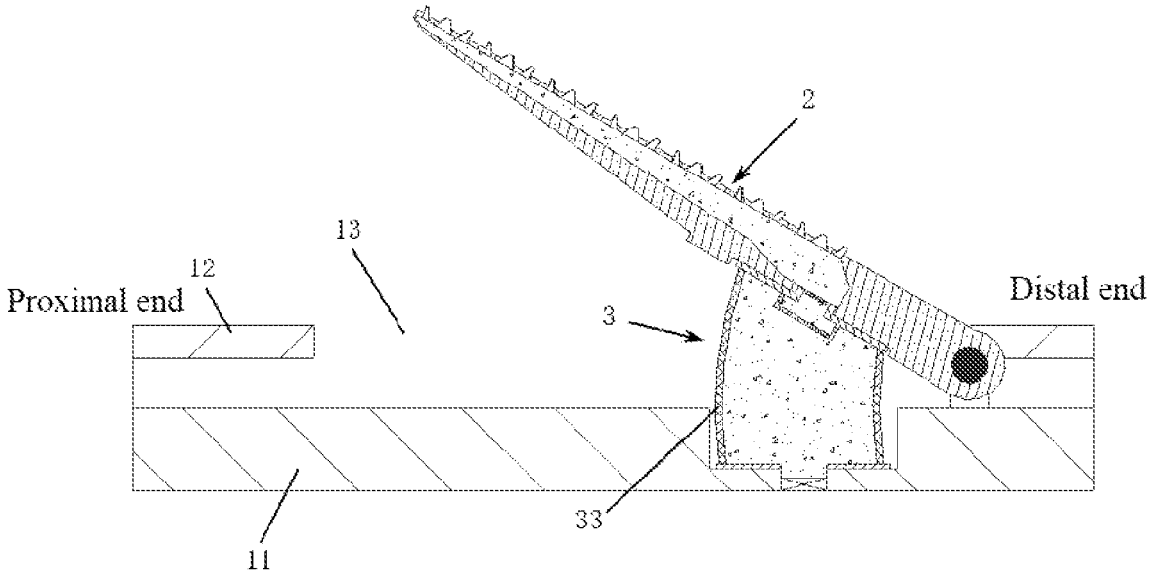
FIG. 6 is a schematic diagram of the anchoring claw supported by the elastic bag structure filled with slurry.
Figure 8:
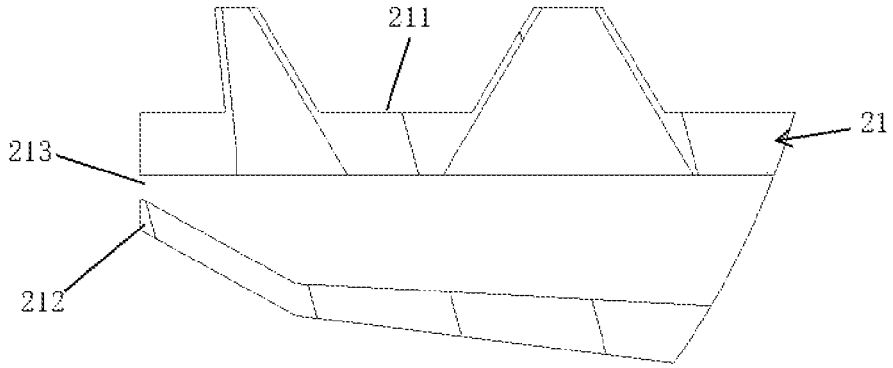
FIG. 8 is an enlarged view of a pointed head of a proximal end of an anchoring claw main body provided with a slurry spraying port.

In one of embodiments, as shown in FIG. 3, FIG. 5 and FIG. 8, the pointed head 212 is provided with at least one slurry spraying port 213. The plurality of grouting nozzles 22 are arranged on a main body outer surface 211 of the anchoring claw main body 21 far away from the inner pipe 11.

In this embodiment, the slurry sprayed from the slurry spraying port 213 of the pointed head 212 is used to condense with the surrounding sand grains, so as to anchor the pointed head 212 in the sand grains. The plurality of grouting nozzles 22 are arranged on the main body outer surface 211 of the anchoring claw main body 21 at intervals to grout into the sand grains around the pipe body 1, so as to increase the grouting region or area.

Figure 7:
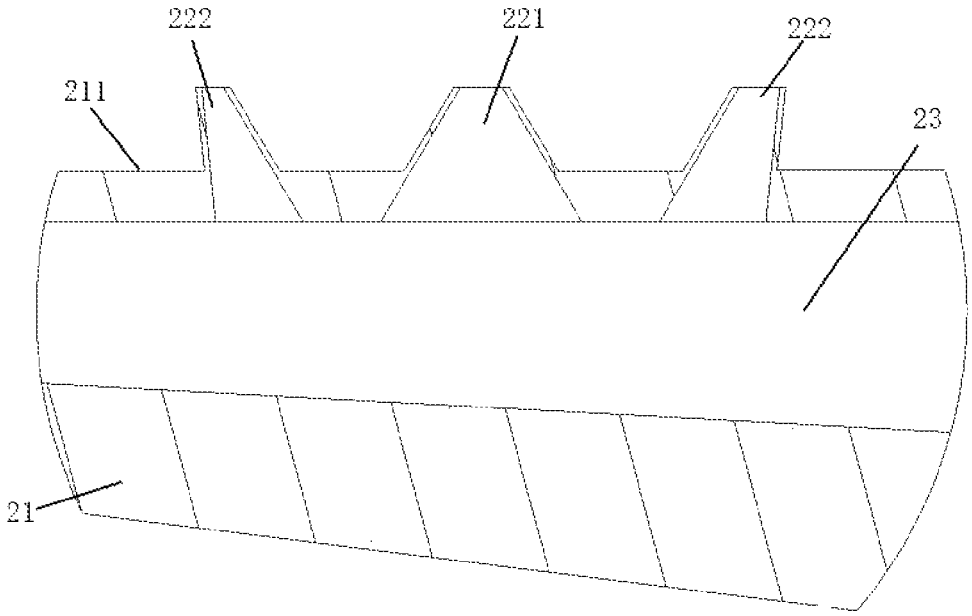
FIG. 7 is an enlarged view of a grouting nozzle.

In one of embodiments, as shown in FIG. 5 and FIG. 7, the grouting nozzle 22 comprises a main nozzle 221 and a plurality of auxiliary nozzles 222 arranged radially around the main nozzle 221. An axis of the main nozzle 221 is vertical to the main body outer surface 211, and an included angle formed between an axis of the auxiliary nozzle 222 and the main body outer surface 211 is an acute angle.

In this embodiment, each grouting nozzle 22 comprises one main nozzle 221 in the middle and the plurality of auxiliary nozzles 222 around the main nozzle. The plurality of auxiliary nozzles 222 are radially arranged around the main nozzle 221, that is, a distance between the auxiliary nozzle 222 and the main nozzle 221 is gradually increased in a direction from a root portion to an end portion of the main nozzle 221, so as to increase the grouting region or the grouting area.

In one of embodiments, as shown in FIG. 1 to FIG. 2 and FIG. 10 to FIG. 11, multiple groups of anchoring claw assemblies are arranged along an axial direction of the pipe body 1, and each group of anchoring claw assemblies comprises a plurality of anchoring claws 2 arranged at intervals along a circumferential direction of the pipe body 1, which facilitates firmly anchoring the pipe body 1 in the sand grains.

In one of embodiments, as shown in FIG. 3, FIG. 5 to FIG. 6, and FIG. 9, a liquid inlet 34 of the elastic bag structure 3 is communicated with a grouting channel of the inner pipe 11, and a first valve 36 is arranged in the liquid inlet 34.

A liquid outlet 35 of the elastic bag structure 3 is communicated with the grouting flow channel 23, and a second valve 37 is arranged in the liquid outlet 35.

The second valve 37 is opened later than the first valve 36.

In this embodiment, the first valve 36 and the second valve 37 may be electric valves or pressure valves. The advantage of opening the second valve 37 later than the first valve 36 is that the elastic bag structure 3 can be completely expanded when filled with the slurry, so as to support the anchoring claw 2 to the maximum angle, and then the second valve 37 is opened, and the anchoring claw 2 starts to grout.

In one of embodiments, when the inner pipe 11 is filled with the slurry and has a pressure up to a first pressure value, the first valve 36 is opened.

When the elastic bag structure 3 is filled with the slurry and has a pressure up to a second pressure value, the second valve 37 is opened.

The second pressure value is greater than the first pressure value.

In this embodiment, the first valve 36 and the second valve 37 are pressure valves. An opening pressure value of the first valve 36 is the first pressure value, and an opening pressure value of the second valve 37 is the second pressure value, wherein the second pressure value is greater than the first pressure value, which may ensure that the second valve 37 is opened later than the first valve 36.

In one of embodiments, as shown in FIG. 3 to FIG. 6 and FIG. 9, the elastic bag structure 3 comprises an outer plate 31 connected with the anchoring claw 2, an inner plate 32 connected with the inner pipe 11, and an annular elastic bag body 33 connected between the outer plate 31 and the inner plate 32.

The liquid inlet 34 is arranged in the inner plate 32, and the liquid outlet 35 is arranged in the outer plate 31.

A reinforcing framework 39 is arranged in the annular elastic bag body 33.

In this embodiment, the elastic bag structure 3 comprises the outer plate 31, the inner plate 32 and the annular elastic bag body 33. The outer plate 31 and the inner plate 32 may be plastic plates, the liquid inlet 34 is arranged in the inner plate 32, and the liquid outlet 35 is arranged in the outer plate 31. The annular elastic bag body 33 may be an annular rubber bag or rubber sleeve. The reinforcing framework 39 is arranged in the annular elastic bag body 33. The reinforcing framework 39 may have a spring structure, which can be stretched, and improves the compression resistance of the annular elastic bag body 33.

When assembling, the outer plate 31 may be connected with the anchoring claw 2 by a fastener, a buckle, an adhesive, and the like, and the inner plate 32 may be connected with the groove bottom of the pipe wall groove 111 by a fastener, a buckle, an adhesive, and the like.

Figure 9:
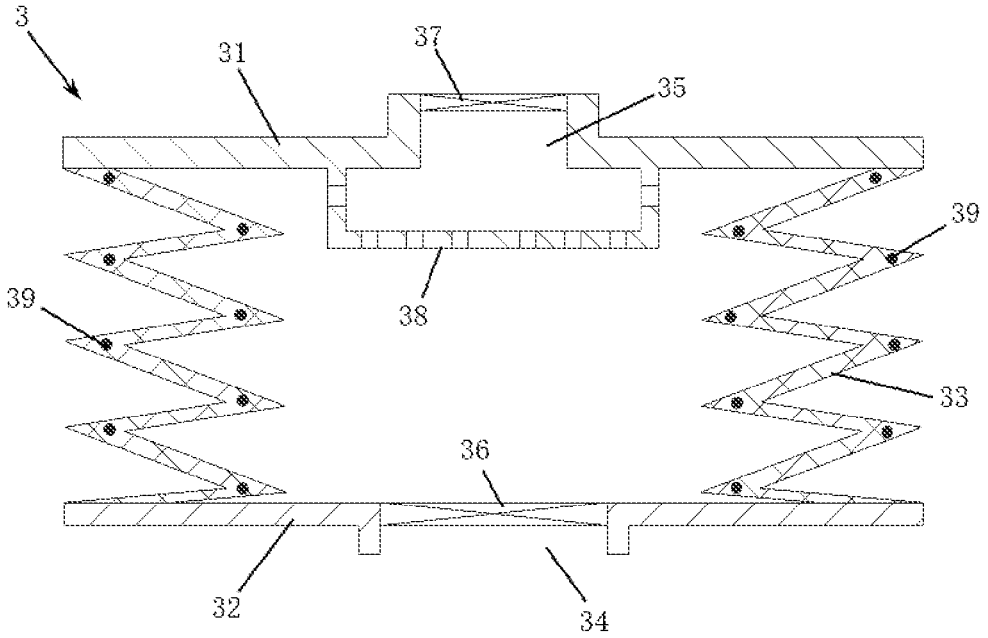
FIG. 9 is a sectional view of the elastic bag structure.
Figure 10:
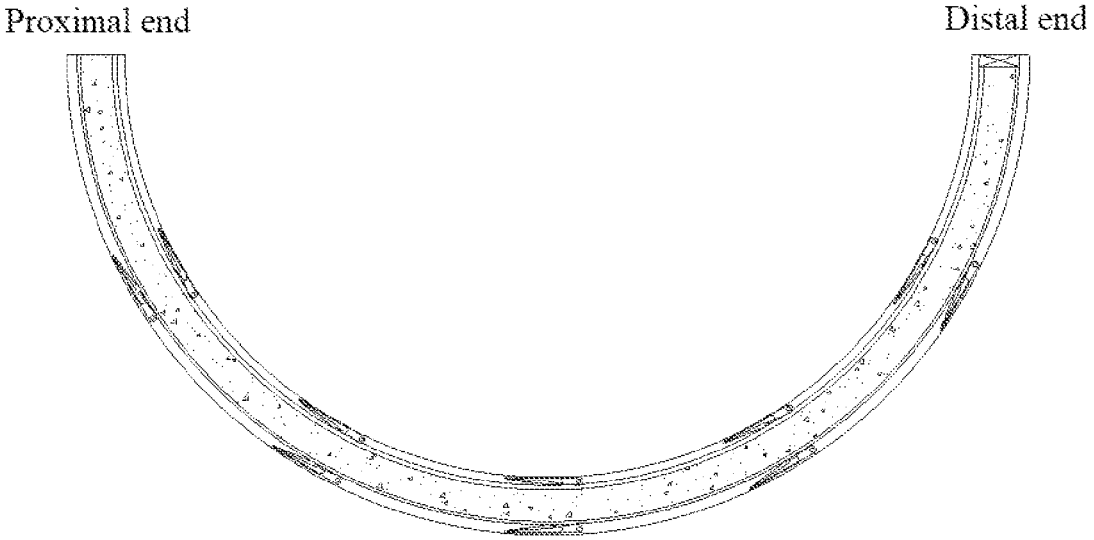
FIG. 10 is a schematic diagram of the anchoring claw in a folded state at a stage of grouting.
Figure 11:
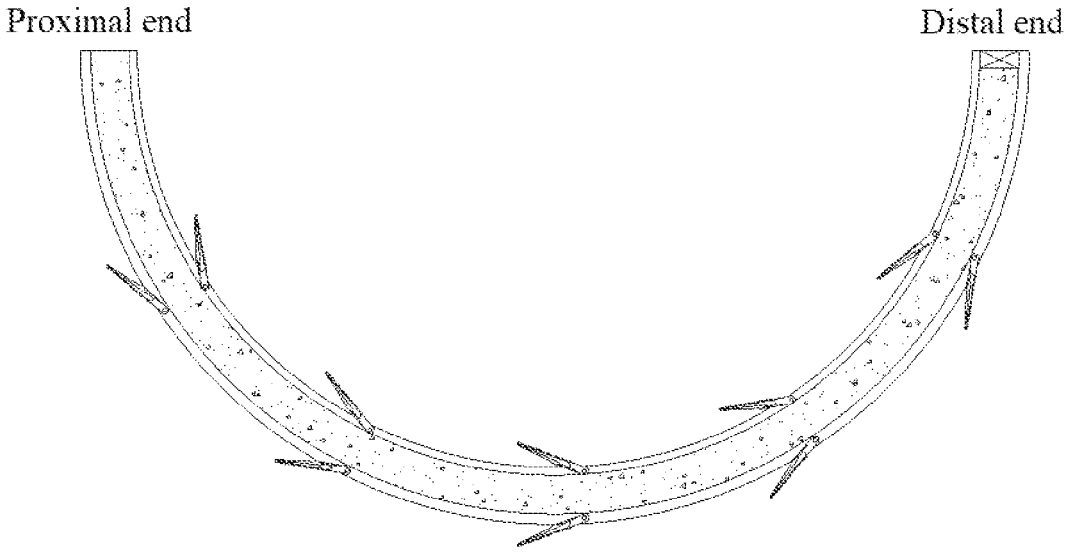
FIG. 11 is a schematic diagram of the anchoring claw in an open state at another stage of grouting.

In one of embodiments, as shown in FIG. 9, in order to prevent the slurry which enters from the liquid inlet 34 from directly rushing to the second valve 37 in the liquid outlet 35, a buffer frame 38 is arranged on an inner side of the liquid outlet 35. The buffer frame 38 is connected with the outer plate 31. The slurry flows to the liquid outlet 35 through a hollow area of the buffer frame 38, and the buffer frame 38 may buffer a pressure given by the slurry to the second valve 37, which is beneficial for opening the second valve 37 later than the first valve 36.

With reference to FIG. 12 to FIG. 18, an embodiment of the present invention provides a construction method of a desert water storage area, wherein the grouting pipe according to any one of the forementioned embodiments is adopted in the construction method of the desert water storage area.

The construction method of the desert water storage area comprises the following steps:

- S01: pre-selecting an area for forming the water storage area in the desert area, pre-planning the number and positions of holes to be drilled, and pre-preparing the grouting pipe;
- S02: drilling the hole and laying the grouting pipe below a desert surface by using a directional drilling machine until the distal end of the pipe body 1 is exposed upwards above the desert surface, and closing the distal end valve 14; wherein the distal end of the pipe body 1 is in the front in a drilling direction;
- S03: starting to grout from the proximal end of the inner pipe 11 until the elastic bag structure 3 supports the anchoring claw 2 outwards;
- S04: pulling the pipe body 1 against a supporting direction of the anchoring claw 2, so that the anchoring claw 2 is inserted into the surrounding sand grains and grouts into the surrounding sand grains;
- S05: repeating the steps S02 to S04 until the construction of holes, the laying of grouting pipes, and the grouting are all finished; and
- S06: forming the isolation layer 5 after the slurry is solidified with the surrounding sand grains, and forming the desert water storage area above the isolation layer 5.

Construction steps of forming the desert water storage area in the desert area by adopting the grouting pipe of the present invention are approximately as follows.

In a first step, an area for forming the water storage area in the desert area is pre-selected, the number of holes to be drilled and the positions of the holes are pre-planned, and the grouting pipe is pre-prepared. For example, as shown in FIG. 12, a hole to be drilled and a curvature of the grouting pipe after laying are pre-planned. As shown in FIG. 17, it is necessary to design a distance D between two adjacent holes 4 along a direction perpendicular to the drilling. The distance D may be calculated according to a grouting radius r of the grouting pipe, preferably $D \leq 2r$. A shape of the hole 4 is set as required, for example, the drilled hole 4 is arc-shaped and a plurality of spaced holes 4 are arranged in an arc, so that a bottom portion of the desert water storage area is a hemisphere or a part of the hemisphere.

In a second step, the hole 4 is constructed below the desert surface by using the directional drilling machine. The hole 4 may be constructed first and then the grouting pipe is laid, alternatively, the hole 4 may be constructed while the grouting pipe is laid. The directional drilling machine is an integrated drilling and grouting machine, which belongs to the prior art, and thus will not be described in detail herein. Specifically, the proximal end of the pipe body 1 is connected with the directional drilling machine. The distal end of the pipe body 1 enters into the drilled hole 4 first, and finally, the distal end of the pipe body 1 is exposed upwards above the desert surface to finish laying the grouting pipe. Then the distal end valve 14 is closed to prevent the slurry from being discharged from the distal end of the inner pipe 11 during grouting.

In a third step, the directional drilling machine is used to start to grout from the proximal end of the inner pipe 11, and after the inner pipe 11 is fully filled with the slurry, the slurry will rush into the elastic bag structure 3, and the elastic bag structure 3 expands to support the anchoring claw 2 outwards.

In a fourth step, the pipe body 1 is pulled against a supporting direction of the anchoring claw 2, so that the anchoring claw 2 is inserted into the surrounding sand grains and grouts into the surrounding sand grains. Specifically, if the anchoring claw 2 obliquely extends towards the proximal end side, the proximal end of the pipe body 1 will be pulled, so that the anchoring claw 2 moves towards the proximal end side and is inserted deeper into the surrounding sand grains. If the anchoring claw 2 obliquely extends towards the distal end side, the distal end of the pipe body 1 will be pulled, so that the anchoring claw 2 moves towards the distal end side and is inserted deeper into the surrounding sand grains.

In a fifth step, the second step to the fourth step are repeated until the construction of holes, the laying of grouting pipes, and the grouting are all finished.

In a sixth step, after the slurry solidifies with the surrounding sand grains, the slurry coming from two adjacent grouting pipes meets and condenses with the sand gains to form the isolation layer 5, so that the desert water storage area is formed above the isolation layer 5, which may be used to store water resource, wherein the water resource may be precipitation or allocated water to facilitate planting on the desert surface, thus realizing sand fixation.

After the isolation layer 5 is formed, the proximal end and the distal end of the pipe body 1 exposed from the desert surface may be removed by cutting as required.

To sum up, according to the grouting pipe and the construction method of the desert water storage area provided by the present invention, the isolation layer 5 can be constructed in any desert area to form the water storage area, which avoids a limitation of desert terrain and expands an application range.

The above technical solutions can be combined as required to achieve the best technical effect.

The above content only describes the principle and the preferable embodiments of the present invention. It is to be pointed out that for those of ordinary skills in the art, several other modifications can be made on the basis of the principle of the present invention, which should also be regarded as the protection scope of the present invention.

The invention claimed is:

1. A grouting pipe, wherein the grouting pipe is configured to construct an isolation layer in a desert area to form a desert water storage area above; wherein the grouting pipe comprises a bendable pipe body and a plurality of anchoring claws connected around the pipe body and provided with a grouting flow channel;

the pipe body comprises an inner pipe and an outer pipe sleeved on the inner pipe, an annular cavity is formed between the inner pipe and the outer pipe, the pipe body comprises a proximal end and a distal end which are oppositely arranged, and a distal end valve is arranged in a distal end of the inner pipe;

the anchoring claw is mounted in the annular cavity through a rotating shaft, an outer pipe opening is arranged in an area on the outer pipe corresponding to the anchoring claw, and the anchoring claw is capable of swinging outwards through the outer pipe opening;

an elastic bag structure capable of driving the anchoring claw to swing outwards is connected between the anchoring claw and the inner pipe, and the elastic bag structure communicates the inner pipe with the grouting flow channel; wherein when the elastic bag structure is in a retracted state, the anchoring claw is accommodated in the annular cavity and/or the outer pipe opening under an action of the elastic bag structure; and when the elastic bag structure is filled with slurry and in an expanded state, the anchoring claw swings outwards through the outer pipe opening, and the anchoring claw swinging outwards is configured to be inserted into surrounding sand grains for grouting into the surrounding sand grains.

2. The grouting pipe according to claim 1, wherein the anchoring claw comprises an anchoring claw main body and a plurality of grouting nozzles arranged at an edge of the anchoring claw main body, the grouting flow channel is arranged in the anchoring claw main body, and the grouting nozzles are communicated with the grouting flow channel;

the rotating shaft is arranged on a distal end side of the outer pipe opening, a distal end of the anchoring claw main body is pivotally connected with the rotating shaft, and a proximal end of the anchoring claw main body is provided with a pointed head; wherein when the anchoring claw swings outwards, the proximal end of the anchoring claw main body obliquely extends towards a proximal end side of the pipe body.

3. The grouting pipe according to claim 2, wherein when the anchoring claw swings outwards through the outer pipe opening, the proximal end of the pipe body is pulled, so that the pointed head of the anchoring claw main body is inserted into the surrounding sand grains.

4. The grouting pipe according to claim 2, wherein the pointed head is provided with at least one slurry spraying port; and the plurality of grouting nozzles are arranged on a main body outer surface of the anchoring claw main body far away from the inner pipe.

5. The grouting pipe according to claim 4, wherein the grouting nozzle comprises a main nozzle and a plurality of auxiliary nozzles arranged radially around the main nozzle, wherein an axis of the main nozzle is vertical to the main body outer surface, and an included angle formed between an axis of the auxiliary nozzle and the main body outer surface is an acute angle.

6. The grouting pipe according to claim 1, wherein multiple groups of anchoring claw assemblies are arranged along an axial direction of the pipe body, and each group of anchoring claw assemblies comprises a plurality of anchoring claws arranged at intervals along a circumferential direction of the pipe body.

7. The grouting pipe according to claim 1, wherein a liquid inlet of the elastic bag structure is communicated with a grouting channel of the inner pipe, and a first valve is arranged in the liquid inlet;

a liquid outlet of the elastic bag structure is communicated with the grouting flow channel, and a second valve is arranged in the liquid outlet; and wherein the second valve is opened later than the first valve.

8. The grouting pipe according to claim 7, wherein when the inner pipe is filled with the slurry and has a pressure up to a first pressure value, the first valve is opened; and when the elastic bag structure is filled with the slurry and has a pressure up to a second pressure value, the second valve is opened; and wherein the second pressure value is greater than the first pressure value.

9. The grouting pipe according to claim 7, wherein the elastic bag structure comprises an outer plate connected with the anchoring claw, an inner plate connected with the inner pipe, and an annular elastic bag body connected between the outer plate and the inner plate, the liquid inlet is arranged in the inner plate, and the liquid outlet is arranged in the outer plate; and a reinforcing framework is arranged in the annular elastic bag body.

10. A construction method of a desert water storage area using the grouting pipe according to claim 9; wherein the construction method of the desert water storage area comprises the following steps:

S01: pre-selecting an area for forming the water storage area in the desert area, pre-planning the number and positions of holes to be drilled, and pre-preparing the grouting pipe;

S02: drilling the hole and laying the grouting pipe below a desert surface by using a directional drilling machine until the distal end of the pipe body is exposed upwards above the desert surface, and closing the distal end valve; wherein the distal end of the pipe body is in the front in a drilling direction;

S03: starting to grout from the proximal end of the inner pipe until the elastic bag structure supports the anchoring claw outwards;

S04: pulling the pipe body against a supporting direction of the anchoring claw, so that the anchoring claw is inserted into the surrounding sand grains and grouts into the surrounding sand grains;

S05: repeating the steps S02 to S04 until the construction of holes, the laying of grouting pipes, and the grouting are all finished; and S06: forming the isolation layer after the slurry is solidified with the surrounding sand grains, and forming the desert water storage area above the isolation layer.

11. The construction method according to claim 10, wherein the anchoring claw comprises an anchoring claw main body and a plurality of grouting nozzles arranged at an edge of the anchoring claw main body, the grouting flow channel is arranged in the anchoring claw main body, and the grouting nozzles are communicated with the grouting flow channel;

the rotating shaft is arranged on a distal end side of the outer pipe opening, a distal end of the anchoring claw main body is pivotally connected with the rotating shaft, and a proximal end of the anchoring claw main body is provided with a pointed head; wherein when the anchoring claw swings outwards, the proximal end of the anchoring claw main body obliquely extends towards a proximal end side of the pipe body.

12. The construction method according to claim 11, wherein when the anchoring claw swings outwards through the outer pipe opening, the proximal end of the pipe body is pulled, so that the pointed head of the anchoring claw main body is inserted into the surrounding sand grains.

13. The construction method according to claim 11, wherein the pointed head is provided with at least one slurry spraying port; and the plurality of grouting nozzles are arranged on a main body outer surface of the anchoring claw main body far away from the inner pipe.

14. The construction method according to claim 13, wherein the grouting nozzle comprises a main nozzle and a plurality of auxiliary nozzles arranged radially around the main nozzle, wherein an axis of the main nozzle is vertical to the main body outer surface, and an included angle formed between an axis of the auxiliary nozzle and the main body outer surface is an acute angle.

15. The construction method according to claim 10, wherein multiple groups of anchoring claw assemblies are arranged along an axial direction of the pipe body, and each group of anchoring claw assemblies comprises a plurality of anchoring claws arranged at intervals along a circumferential direction of the pipe body.

16. The construction method according to claim 10, wherein a liquid inlet of the elastic bag structure is communicated with a grouting channel of the inner pipe, and a first valve is arranged in the liquid inlet;

a liquid outlet of the elastic bag structure is communicated with the grouting flow channel, and a second valve is arranged in the liquid outlet; and wherein the second valve is opened later than the first valve.

17. The construction method according to claim 16, wherein when the inner pipe is filled with the slurry and has a pressure up to a first pressure value, the first valve is opened; and when the elastic bag structure is filled with the slurry and has a pressure up to a second pressure value, the second valve is opened; and wherein the second pressure value is greater than the first pressure value.

18. The construction method according to claim 16, wherein the elastic bag structure comprises an outer plate connected with the anchoring claw, an inner plate connected with the inner pipe, and an annular elastic bag body connected between the outer plate and the inner plate, the liquid inlet is arranged in the inner plate, and the liquid outlet is arranged in the outer plate; and a reinforcing framework is arranged in the annular elastic bag body.

* * * * *